US011517092B1

(12) United States Patent
Salter

(10) Patent No.: US 11,517,092 B1
(45) Date of Patent: Dec. 6, 2022

(54) ERGONOMIC HANDLE-LESS HAIR DRYER

(71) Applicant: Damien Salter, Los Angeles, CA (US)

(72) Inventor: Damien Salter, Los Angeles, CA (US)

( * ) Notice: Subject to any disclaimer, the term of this patent is extended or adjusted under 35 U.S.C. 154(b) by 78 days.

(21) Appl. No.: 17/204,825

(22) Filed: Mar. 17, 2021

(51) Int. Cl.
*A45D 20/12* (2006.01)

(52) U.S. Cl.
CPC ..... *A45D 20/12* (2013.01)

(58) Field of Classification Search
CPC .. A45D 20/00; A45D 20/12; A45D 2210/205; A45D 20/122
USPC ..... 34/95–100
See application file for complete search history.

(56) References Cited

U.S. PATENT DOCUMENTS 1,630,115 A * 5/1927 Louis ..... A61H 23/0263 601/74
2,018,046 A * 10/1935 Wilson ..... A61H 23/0263 601/74
2,523,201 A * 9/1950 Ellis ..... B26B 19/44 30/131
3,261,107 A * 7/1966 Ponczek ..... A45D 20/10 417/423.15
4,138,827 A * 2/1979 Baugh ..... A45D 20/10 132/212
4,620,374 A * 11/1986 Patterson ..... A45D 20/12 392/383
D301,231 S * 5/1989 Yoshiharu ..... D28/13
5,058,193 A * 10/1991 Appierto ..... F24H 3/0423 34/97
5,133,043 A * 7/1992 Baugh ..... A45D 20/10 34/667
5,526,578 A * 6/1996 Iyer ..... A45D 20/50 239/443
5,727,331 A * 3/1998 Thaler ..... A45D 20/12 34/97
6,067,724 A * 5/2000 Depoyian ..... A45D 20/12 392/383
6,317,998 B1 * 11/2001 Benevelli ..... A45D 20/12 219/222
D480,833 S * 10/2003 Zimmermann ..... D28/13
6,782,636 B2 * 8/2004 Feldman ..... A45D 20/50 392/383
8,782,920 B2 * 7/2014 Marthinsen ..... A45D 20/12 132/211
9,930,950 B1 * 4/2018 Cage ..... A45D 20/12
10,973,298 B2 * 4/2021 Kennedy ..... A45D 20/124
2008/0216339 A1 * 9/2008 Gray ..... A45D 20/10 392/383
2013/0008043 A1 * 1/2013 Correll, Jr. ..... A45D 20/12 34/97
2020/0230442 A1 * 7/2020 Shami ..... A45D 7/04
2021/0321738 A1 * 10/2021 Nl ..... A45D 20/122

FOREIGN PATENT DOCUMENTS

DE 2932127 A1 * 2/1981
GB 1502401 A * 3/1978 ..... A45D 20/12
WO WO-8801838 A1 * 3/1988

* cited by examiner

*Primary Examiner* — Stephen M Gravini
(74) *Attorney, Agent, or Firm* — Pacifica IP

(57) ABSTRACT

An ergonomic handle-less hairdryer having a rotating adjustable strap allowing a user to hold and use the hairdryer in either hand without causing undue strain on the user's hand.

5 Claims, 3 Drawing Sheets

101

ERGONOMIC HANDLE-LESS HAIR DRYER

BACKGROUND OF THE INVENTION

The present invention generally relates to a hair dryer, more particularly to an ergonomic handle-less hair dryer.

Conventional hand-held hairdryers used in salons and at home typically have handles extending from the main body of the hairdryer. These conventional hair dryers result in awkward hand and body positions, making hair drying tedious and difficult. Indeed, conventional hand-held hairdryers have been shown to cause or lead to arthritis, carpal tunnel, muscle spasms, sciatica, and nerve damage, for example.

The present invention addresses these issues by providing a handle-less hairdryer with ergonomic features by encouraging natural hand positioning.

SUMMARY OF THE INVENTION

The present invention is directed to a handle-less hair dryer having a housing comprising an air inlet and an air outlet, the housing having a circumference; a first recess formed along an upper half of said circumference of the housing; a second recess formed along the upper half of the circumference of the housing, the second recess spaced from the first recess; an adjustable strap attached to the housing and held within the first and second recesses; an on/off switch provided on the housing; and a plurality of buttons provided in between the first and second recesses for controlling heat and speed of the handle-less hairdryer; wherein a user can hold said handle-less hair dryer by the housing in either hand without gripping the housing; and wherein the adjustable strap can rotate around the housing by sliding through said first and second recesses.

In one embodiment, the adjustable strap can rotate at least 180 degrees around the housing. In the same or alternate embodiment, a rechargeable battery is held within the housing allowing the hairdryer to operate without a cord. In the same or alternate embodiment, the plurality of buttons are provided on a top of said housing. In the same or alternate embodiment, some of the buttons are staggered to allow for access to the buttons with either hand of the user.

BRIEF DESCRIPTION OF THE DRAWINGS

A more complete understanding of the present invention may be obtained with reference to the Detailed Description when taken in conjunction with the accompanying Drawings.

DETAILED DESCRIPTION OF THE INVENTION

Figure 1:
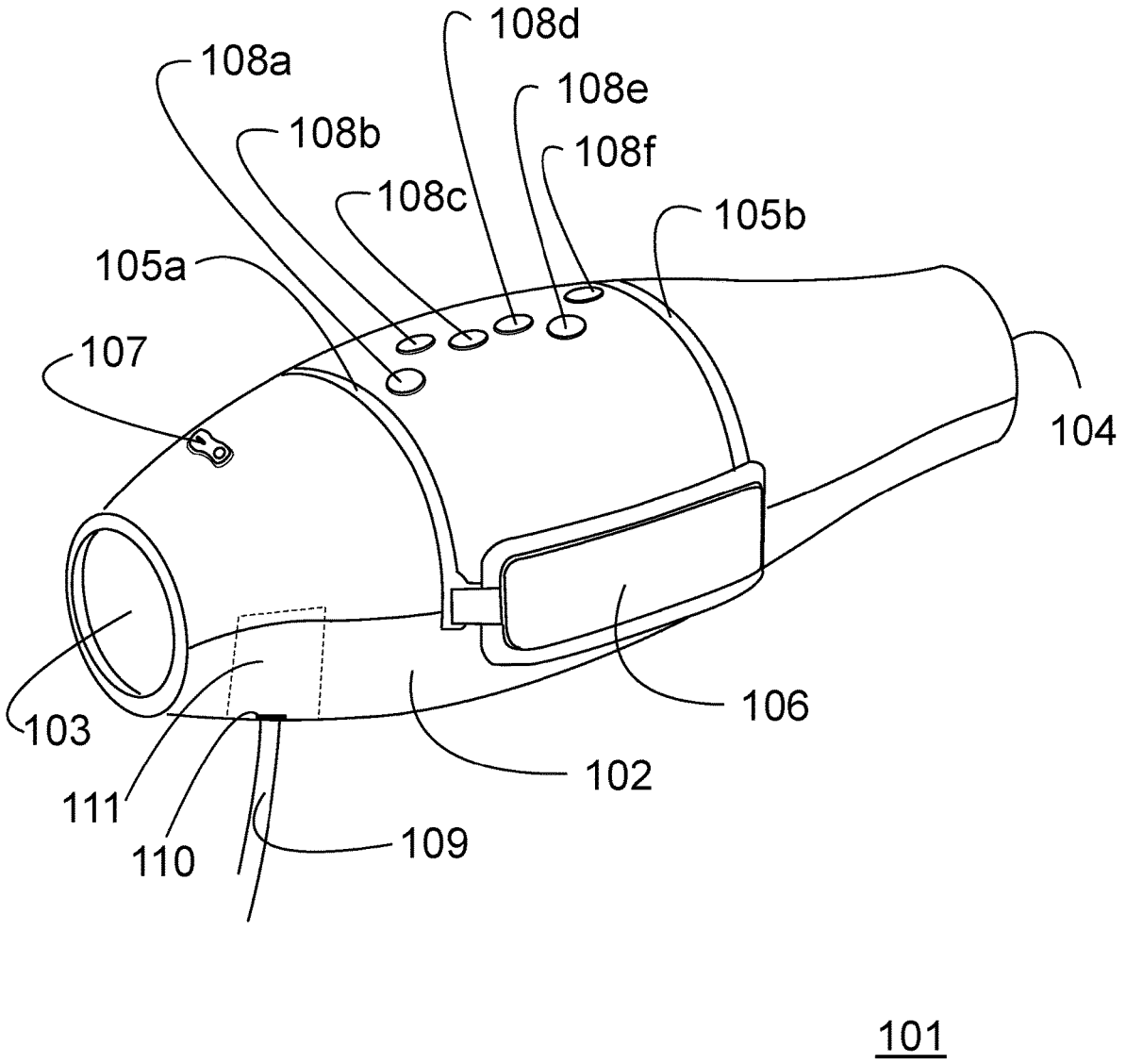
FIG. 1 is a perspective view of the ergonomic handle-less hair dryer in accordance with one aspect of the present invention.
Figure 2:
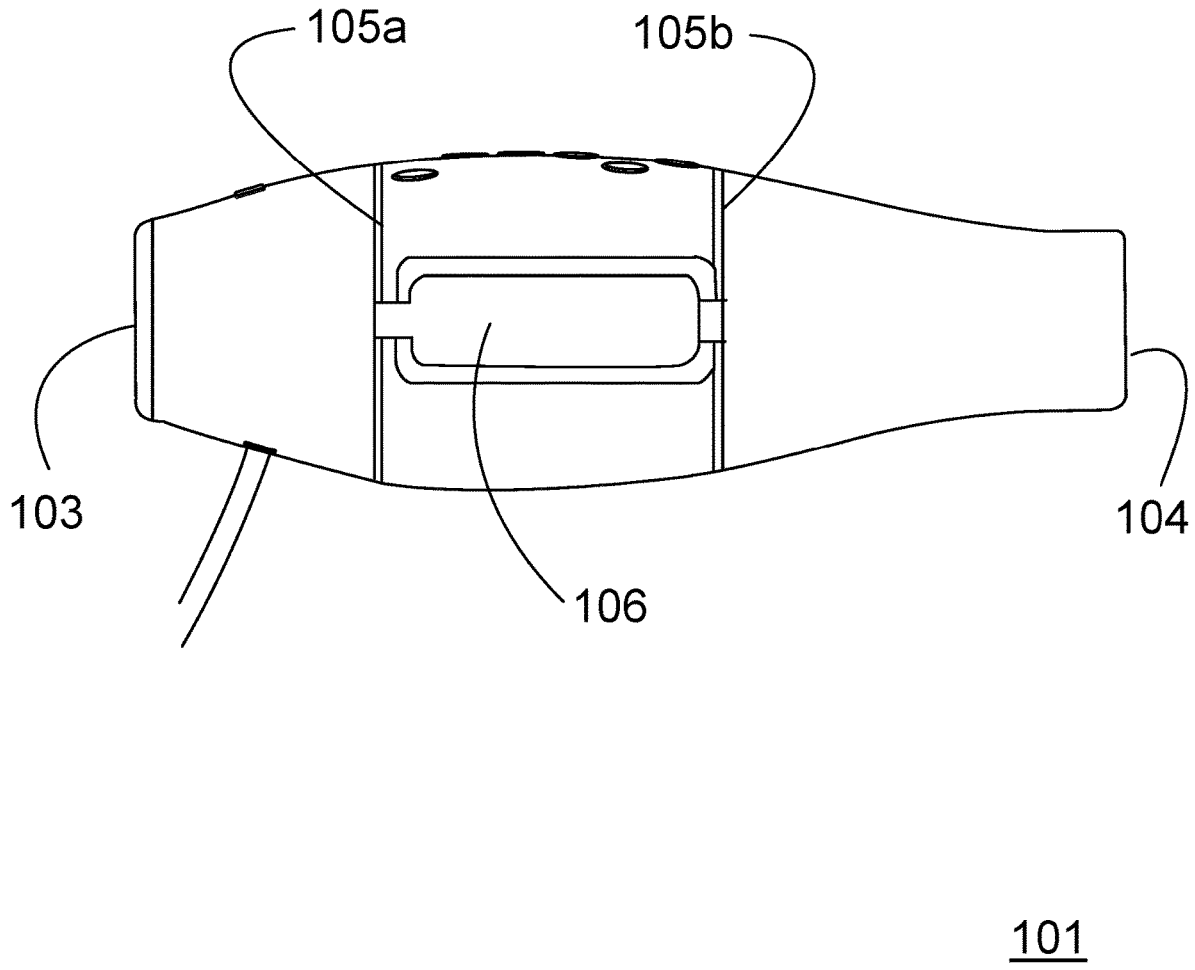
FIG. 2 is a side view of the ergonomic handle-less hair dryer of FIG. 1.

Referring now to FIG. 1, ergonomic handle-less hair dryer 101 is shown. Ergonomic handle-less hair dryer 101 has a housing 102 having an air inlet 103 and an air outlet 104. Housing 102 is generally tubular. Provided along housing 102 are first and second recesses or channels or gutters 105*a* and 105*b*, which allow adjustable strap 106 to slide around the circumference of the housing 102.

Adjustable strap 106 is held in the housing by mechanical parts such as two attached rings rotating in the recesses 105*a* and 105*b*, for example.

Figure 3:
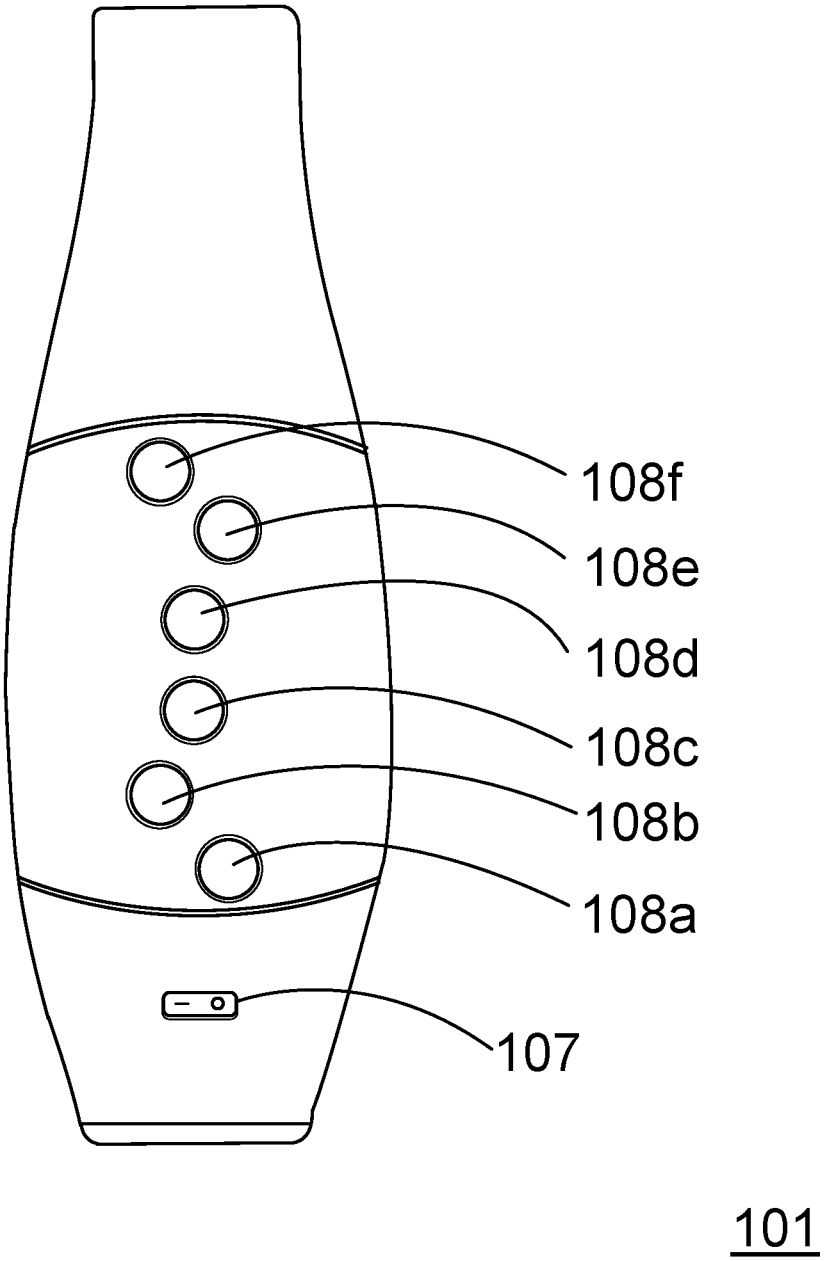
FIG. 3 is a top view of the ergonomic handle-less hair dryer of FIG. 1.

Also provided on housing 102 is an on/off switch 107 and speed and heat control buttons 108*a-f*. Speed functions can include low, medium and high; heat functions can include hot, cold and warm, for example. Control buttons 108*a-f* are arranged and staggered as shown in FIGS. 1 and 3 for easy ergonomic access by a user's fingers.

In use, a user can hold hairdryer 101 in either hand by sliding adjustable strap 106 around the housing 102 of hairdryer 101. As mentioned above, control buttons 108*a-f* are positioned such that a user can reach control buttons 108*a-f* with either a right-hand or left-hand grip. Adjustable strap 106 reduces the amount of gripping required to hold hairdryer 101, and allows for a natural grip, improving ergonomics.

Hairdryer 101 can be used corded or cordless. Internal battery 111 is provided in housing 102. Battery 111 can be rechargeable via cord 109.

Adjustable strap 106 can rotate around the body of hairdryer, approximately 180 degrees to allow the hairdryer 101 to be held in either hand.

A heat-resistant plastic can be used around the body of the hairdryer or underneath portions that a user's hand would touch the hairdryer.

While the foregoing written description of the invention enables one of ordinary skill in the art to make and use the invention, those of ordinary skill in the art will understand and appreciate the existence of variations, combination, and equivalents of the embodiments, methods, and examples provided herein. The invention should, therefore, not be limited by the embodiments and examples disclosed here, but by all embodiments and methods within the scope and spirit of the invention as claimed.

The invention claimed is:

1. A handle-less hair dryer comprising:

a housing comprising an air inlet and an air outlet, said housing having a circumference;

a first recess formed along an upper half of said circumference of said housing;

a second recess formed along said upper half of said circumference of said housing, said second recess spaced from said first recess;

an adjustable strap attached to said housing and held within said first and second recesses;

an on/off switch provided on said housing; and a plurality of buttons provided in between said first and second recesses for controlling heat and speed of the handle-less hairdryer;

wherein a user can hold said handle-less hair dryer by said housing in either hand without gripping said housing; and wherein the adjustable strap can rotate around said housing by sliding through said first and second recesses.

2. The handle-less hair dryer of claim 1, wherein the adjustable strap can rotate at least 180 degrees around said housing.

3. The handle-less hair dryer of claim 1, wherein a rechargeable battery is held within said housing allowing the hairdryer to operate without a cord.

4. The handle-less hair dryer of claim 1, wherein said plurality of buttons are provided on a top of said housing.

5. The handle-less hair dryer of claim 1, wherein some of said plurality of buttons are staggered to allow for access to said buttons with either hand of the user.

* * * * *